US005374166A

United States Patent [19]

Fukui

[11] Patent Number: 5,374,166

[45] Date of Patent: Dec. 20, 1994

[54] MOTOR DRIVEN FLUID COMPRESSOR WITHIN HERMETIC HOUSING

[75] Inventor: Tsuyoshi Fukui, Isesaki, Japan

[73] Assignee: Sanden Corporation, Gunma, Japan

[21] Appl. No.: 177,696

[22] Filed: Jan. 4, 1994

Related U.S. Application Data

[63] Continuation of Ser. No. 905,437, Jun. 29, 1992, abandoned.

[30] Foreign Application Priority Data

Jun. 28, 1991 [JP] Japan ..... 3-057942[U]

[51] Int. Cl.[5] ..... F04B 35/04; F04C 18/04

[52] U.S. Cl. ..... 417/410.5; 417/902; 418/55.1

[58] Field of Search ..... 417/410 B, 410 C, 410 D, 417/902, 53; 418/55.1

[56] References Cited

U.S. PATENT DOCUMENTS 4,435,136 3/1984 Terauchi et al. .
4,512,729 4/1985 Sakamoto et al. .
4,940,342 7/1990 Miyzazawa et al. .

FOREIGN PATENT DOCUMENTS 0182482 8/1986 Japan ..... 418/55.1
0218879 8/1990 Japan ..... 418/55.1
0277988 11/1990 Japan ..... 418/55.1

*Primary Examiner*—Richard E. Gluck
*Attorney, Agent, or Firm*—Baker & Botts

[57] ABSTRACT

A motor driven fluid compressor having compression and drive mechanisms within a hermetically sealed housing is disclosed. The compressor includes the compression mechanism, and the drive mechanism. A drive shaft and a motor rotates the drive shaft. A hermetically sealed housing contains the compression mechanism and the drive mechanism. The drive shaft is operatively connected to the compression mechanism, and is rotatably supported by a first inner block and a second inner block which is axially spaced from the first inner block. The first and second inner blocks are integral with first and second portions of the housing, respectively. As a result, the longitudinal axis of holes formed within the first and second inner blocks and the longitudinal axis of the compressor housing are easily and precisely aligned without increasing in the manufacturing cost.

15 Claims, 4 Drawing Sheets

MOTOR DRIVEN FLUID COMPRESSOR WITHIN HERMETIC HOUSING

This application is a continuation of application Ser. No. 07/905,437, filed Jun. 29, 1992, now abandoned.

TECHNICAL FIELD OF THE INVENTION

This invention relates to a fluid compressor, and more particularly to a motor driven fluid compressor having the compression and drive mechanisms within a hermetically sealed container.

BACKGROUND OF THE INVENTION

Description of The Prior Art

FIGS. 3 and 4 illustrate two prior art motor driven fluid compressors. The operation of each of the prior art compressors is well known in the art so that an explanation thereof is omitted.

FIG. 3 illustrates one motor driven fluid compressor having the compression and drive mechanisms within a hermetically sealed housing as disclosed in Japanese Utility Model Application Publication No. 63-105780.

With reference to FIG. 3, compressor 200 includes hermetically sealed housing 210 which contains a compression mechanism, such as scroll type fluid compression mechanism 220 and drive mechanism 230 therein. Housing 210 includes cylindrical portion **210*a*, and first and second cup-shaped portions 210*b* and 210*c*. An opening end of first cup-shaped portion 210*b* is hermetically connected to an upper opening end of cylindrical portion 210*a* by, for example, brazing. An opening end of second cup-shaped portion 210*c* is hermetically connected to a lower opening end of cylindrical portion 210*a*** by, for example, brazing.

Scroll type fluid compression mechanism 220 includes fixed scroll 221 having circular end plate **221*a* and spiral element 221*b* which downwardly extends from circular end plate 221*a*. Circular end plate 221*a* of fixed scroll 221 is fixedly disposed within first cup-shaped portion 210*b* by, for example, forcible insertion. First inner block 240 is fixedly disposed within an upper region of cylindrical portion 210*a* by, for example, forcible insertion and is fixedly connected to circular end plate 221*a* of fixed scroll 221 by a plurality of bolts 250. Scroll type fluid compression mechanism 220 further includes orbiting scroll 222 having circular end plate 222*a* and spiral element 222*b* which upwardly extends from circular end plate 222*a*. Spiral element 221*b* of fixed scroll 221 interfits with spiral element 222*b* of orbiting scroll 222 with an annular and radial offset. Circular end plate 222*a* of orbiting scroll 222 is radially slidably disposed on an upper end surface of first inner block 240**.

Drive mechanism 230 includes drive shaft 231 and motor 232 surrounding drive shaft 231. Drive shaft 231 includes pin member **231*a* which upwardly extends from and is integral with an upper end of drive shaft 231. The axis of pin member 231*a* is offset from the axis of drive shaft 231, and pin member 231*a* is operatively connected to circular end plate 222*a* of orbiting scroll 222. Rotation preventing mechanism 260 is disposed between first inner block 240 and circular end plate 222*a* of orbiting scroll 222 so that orbiting scroll 222 only orbits during rotation of drive shaft 231. First inner block 240 includes first central opening 241 within which bearing 270 is fixedly disposed so as to rotatably support an upper end portion of drive shaft 231**.

Second inner block 280 axially spaced from first inner block 240 is fixedly disposed within a lower region of cylindrical portion **210*a* of housing 210 by, for example, forcible insertion. Second inner block 280 includes second central opening 281 within which bearing 290 is fixedly disposed so as to rotatably support a lower end portion of drive shaft 231. Motor 232 includes annular-shaped rotor 232*a* fixedly surrounding an exterior surface of drive shaft 231 and annular-shaped stator 232*b* surrounding rotor 232*a* with a radial air gap. Stator 232*b* are fixedly sandwiched by first and second inner blocks 240 and 280**.

In this prior art compressor, first and second inner blocks 240 and 280 and cylindrical portion **210*a* of housing 210 are separately prepared before assembling the compressor. Therefore, as far as the above elements are prepared by a normal precise machining manner, it is difficult to obtain the compressor where the longitudinal axis of first central opening 241 of first inner block 240 and the longitudinal axis of second central opening 281 of second inner block 280, and the longitudinal axis of drive shaft 231 and the longitudinal axis of cylindrical portion 210*a* of housing 210 are easily and precisely aligned. Therefore, an exterior surface of drive shaft 231 non-uniformly contacts to an inner peripheral surface of the inner ring of bearings 270 and 290, thereby causing fragmentation of the exterior surface of drive shaft 231 and damage of bearings 270 and 290 during operation of the compressor. This impulse alignment causes malfunction of the compressor. Furthermore, a non-uniform radial air gap is created between rotor 232*a* and stator 232*b* of motor 232, thereby causing a decrease in efficiency of motor 232**.

The above-mentioned defects may be resolved, if highly precise machining and assembling manners are used in the manufacturing process of the compressor. However, this requires a complicated manufacturing process of the compressor, thereby increasing manufacturing costs.

In order to resolve the aforementioned defects without providing a complicated manufacturing process of the compressor and increasing the manufacturing costs, Japanese Patent Application Publication No. 1-237376 discloses another motor driven fluid compressor having the compression and drive mechanisms within a hermetically sealed housing as illustrated in FIG. 4. In the drawing, the same numerals are used to denote the substantially the same elements shown in FIG. 3.

With reference to FIG. 4, compressor 300 includes inner block 340 having generally circular disc-shaped portion 341 which is fixedly disposed within cylindrical portion **210*a* of housing 210 by, for example, forcible insertion. Inner block 340 includes central bore 342 formed through circular disc-shaped portion 341. Annular projection 343 downwardly projects from a lower peripheral end surface of a central bore 342, and terminates at a location which is a midway of cylindrical portion 210*a*. A plurality of curved plate-shaped projections 344 downwardly project from the lower end surface of a peripheral region of circular disc-shaped portion 341, and terminate at a location which is the midway of cylindrical portion 210*a***.

An upper end portion of drive shaft 231 passes through central bore 342 and annular projection 343, and is rotatably supported by bearing 270 fixedly disposed within central bore 342 and a pair of plain bearings 343*a* and 343*b* fixedly disposed within annular projection 343. Annular-shaped rotor 232*a* fixedly surrounds an exterior surface of drive shaft 231. Annular stator 232*b* of motor 232 is fixedly connected to curved plate-shaped projections 344 by a plurality of corresponding bolts 345.

In this prior art compressor, drive shaft 231 is rotatably and solely supported by inner block 340. Therefore, even though an axial length of central bore 342 of inner block 340 is relatively large, the excessive radial thrust force acts on bearings 270, 343*a* and 343*b* in a severe operating condition of the compressor in comparison with the prior art compressor shown in FIG. 3 where bearings 270 and 290 are axially spaced from each other with a sufficiently long distance. This severe operating coalition causes unfavorable abrasion of bearings 270, 343*a* and 343*b*, thereby decreasing the life thereof.

SUMMARY OF THE INVENTION

It is an object of the present invention to provide an improved construction of a motor driven fluid compressor where the longitudinal axis of holes of a pair of axially spaced supporting members which rotatably support a drive shaft are easily and precisely aligned each other, without increasing the manufacturing cost.

It is another object of the present invention to provide an improved construction of a motor driven fluid compressor where the longitudinal axis of the drive shaft to which an annular rotor of a motor is fixedly connected is easily and precisely aligned with the longitudinal axis of a compressor housing within which an annular stator of the motor is fixedly disposed, without increasing the manufacturing cost.

According to the present invention, a compressor includes a compressing mechanism for compressing a gaseous fluid, a driving mechanism for driving the compressing mechanism, and a housing containing the compressing and the driving mechanisms. The driving mechanism includes a drive shaft operatively connected to the compressing mechanism. A first supporting member includes a first hole centrally formed therein. A second supporting member includes a second hole centrally formed therein. The first supporting member is axially spaced from the second supporting member. The drive shaft is rotatably supported the first and second holes. The housing includes at least first and second portions which form a part thereof. The first supporting member is integral with the first portion of the housing. The second supporting member is integral with the second portion of the housing.

Further objects, features and other aspects of this invention will be understood from the detailed description of the preferred embodiment of this invention with reference to the annexed drawings.

DETAILED DESCRIPTION OF THE INVENTION

Figure 1:
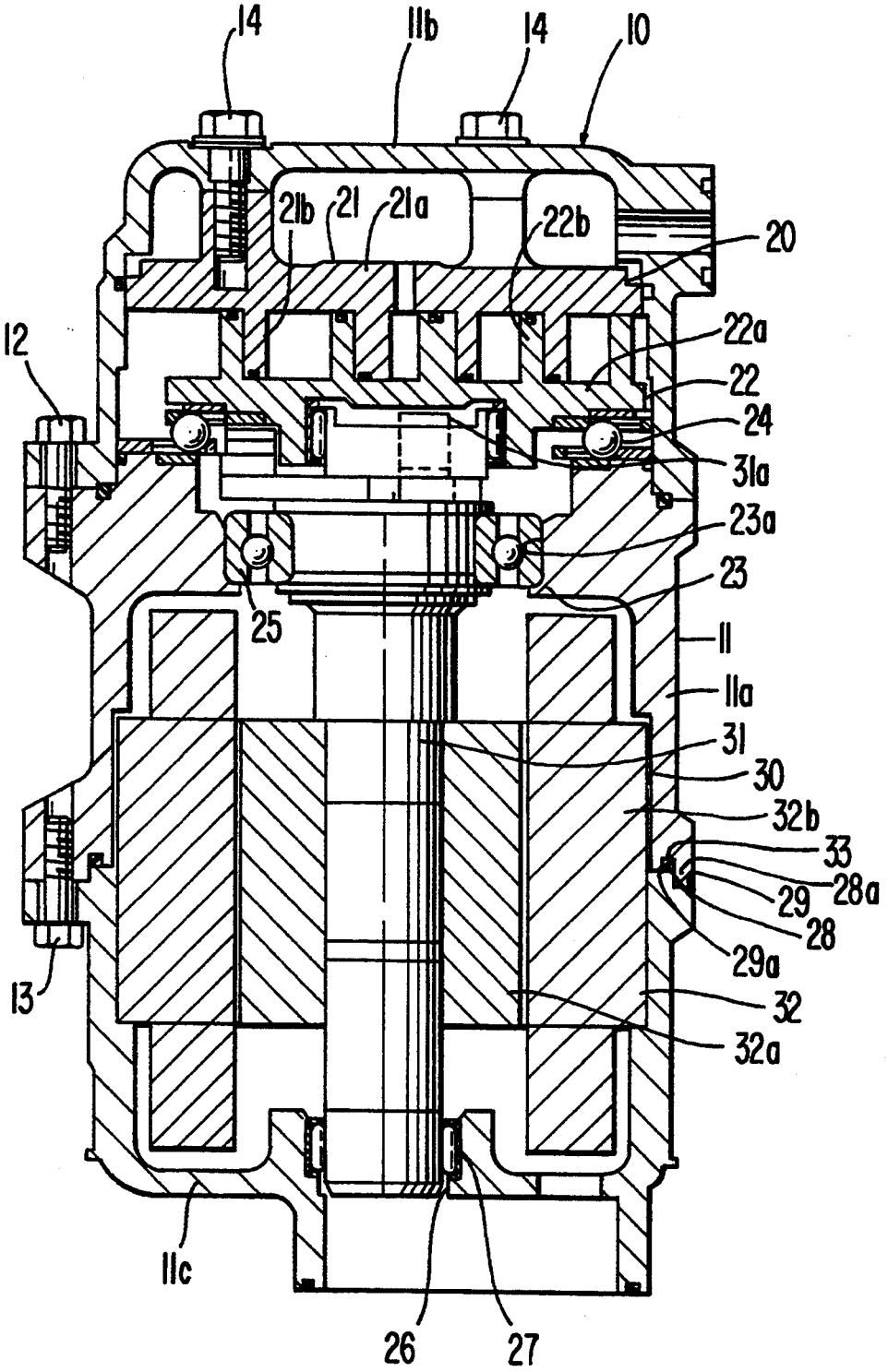
FIG. 1 is a vertical longitudinal sectional view of a motor driven fluid compressor with a hermetic housing in accordance with a first embodiment of this invention.

FIG. 1 illustrates a motor driven fluid compressor in accordance with a first embodiment of the present invention.

With reference to FIG. 1, compressor 10 includes housing 11 which contains a compression mechanism, such as scroll type fluid compression mechanism 20 and drive mechanism 30 therein. Housing 11 includes cylindrical portion 11*a*, and first and second cup-shaped portions 11*b* and 11*c*. An opening end of first cup-shaped portion 11*b* is releasably and hermetically connected to an upper opening end of cylindrical portion 11*a* by a plurality of bolts 12. An opening end of second cup-shaped portion 11*c* is releasably and hermetically connected to a lower opening end of cylindrical portion 11*a* by a plurality of bolts 13.

Scroll type fluid compression mechanism 20 includes fixed scroll 21 having circular end plate 21*a* and spiral element 21*b* which downwardly extends from circular end plate 21*a*. Circular end plate 21*a* of fixed scroll 21 is fixedly disposed within first cup-shaped portion 11*b* by a plurality of bolts 14. Inner block 23 extends radially inwardly from and is integral with the upper opening end of cylindrical portion 11*a* of housing 11. Scroll type fluid compression mechanism 20 further includes orbiting scroll 22 having circular end plate 22*a* and spiral element 22*b* which upwardly extends from circular end plate 22*a*. Spiral element 21*b* of fixed scroll 21 interfits with spiral element 22*b* of orbiting scroll 22 with an angular and radial offset.

Drive mechanism 30 includes drive shaft 31 and motor 32 surrounding drive shaft 31. Drive shaft 31 includes pin member 31*a* which upwardly extends from and is integral with an upper end of drive shaft 31. The axis of pin member 31*a* is offset from the axis of drive shaft 31, and pin member 31*a* is operatively connected to circular end plate 22*a* of orbiting scroll 22. Rotation preventing mechanism 24 is disposed between inner block 23 and circular end plate 22*a* of orbiting scroll 22 so that orbiting scroll 22 only orbits during rotation of drive shaft 31. Inner block 23 forms a supporting member and includes a first central hole 23*a* of which the longitudinal axis is concentric with the longitudinal axis of cylindrical portion 11*a*. Bearing 25 is fixedly disposed within first central hole 23*a* so as to rotatably support an upper end portion of drive shaft 31. Second cup-shaped portion 11*c* from another supporting member and includes a second central hole 26 of which the longitudinal axis is concentric with the longitudinal axis of second cup-shaped portion 11*c*. Bearing 27 is fixedly disposed within second central hole 26 so as to rotatably support a lower end portion of drive shaft 31.

Motor 32 includes annular-shaped rotor 32*a* fixedly surrounding an exterior surface of drive shaft 31 and annular-shaped stator 32*b* surrounding rotor 32*a* with a radial air gap. Stator 32*b* axially extends along a lower opening end region of cylindrical portion 11*a* and an opening end region of second cup-shaped portion 11*c*. A lower half portion of stator 32*b* is fixedly disposed within the opening end region of second cup-shaped portion 11*c* by, for example, forcible insertion.

First annular cut-out section 28 is formed at an inner periphery of the lower opening end surface of cylindrical portion 11*a* of housing 11. Consequently, first annular projection 28*a* is formed at an outer periphery of the lower opening end surface of cylindrical portion 11*a*. The longitudinal axis of an inner periphery of first annular projection 28*a* is concentric with the longitudinal axis of cylindrical portion 11*a*. Second annular cut-out section 29 is formed at an outer periphery of the opening end surface of second cup-shaped portion 11*c* of housing 11. Consequently, second annular projection 29*a* is formed at an inner periphery of the opening end surface of second cup-shaped portion 11*c*. The longitudinal axis of an outer periphery of second annular projection 29*a* is concentric with the longitudinal axis of second cup-shaped portion 11*c*. By means of the above construction, the opening end of second cup-shaped portion 11*c* and the lower opening end of cylindrical portion 11*a* are connected to each other by a faucet joint. O-ring seal element 33 is disposed at a bottom end surface of first annular cut-out section 28 to seal the mating surfaces of first annular cut-out section 28 and second annular projection 29*a*.

In accordance with the construction of the compressor of the first embodiment, the longitudinal axis of first central hole 23*a* of inner block 23 can be easily and precisely aligned with the longitudinal axis of cylindrical portion 11*a* of housing 11 by a normal machining manner because inner block 23 and cylindrical portion 11*a* are formed in one body. Furthermore, the longitudinal axis of second central hole 26 of second cup-shaped portion 11*c* can be easily and precisely aligned with the longitudinal axis of second cup-shaped portion 11*c* by a normal machining manner because second central hole 26 is formed at a bottom end region of second cup-shaped portion 11*c*. In addition, cylindrical portion 11*a* and second cup-shaped portion 11*c* are easily and precisely connected by a well-known joint mechanism, such as a faucet joint. Accordingly, the longitudinal axis of first and second central holes 23*a* and 26, the longitudinal axis of drive shaft 31, the longitudinal axis of cylindrical portion 11*a* and the longitudinal axis of second cup-shaped portion 11*c* can be easily and precisely aligned without a complicated manufacturing process for the compressor.

Figure 2:
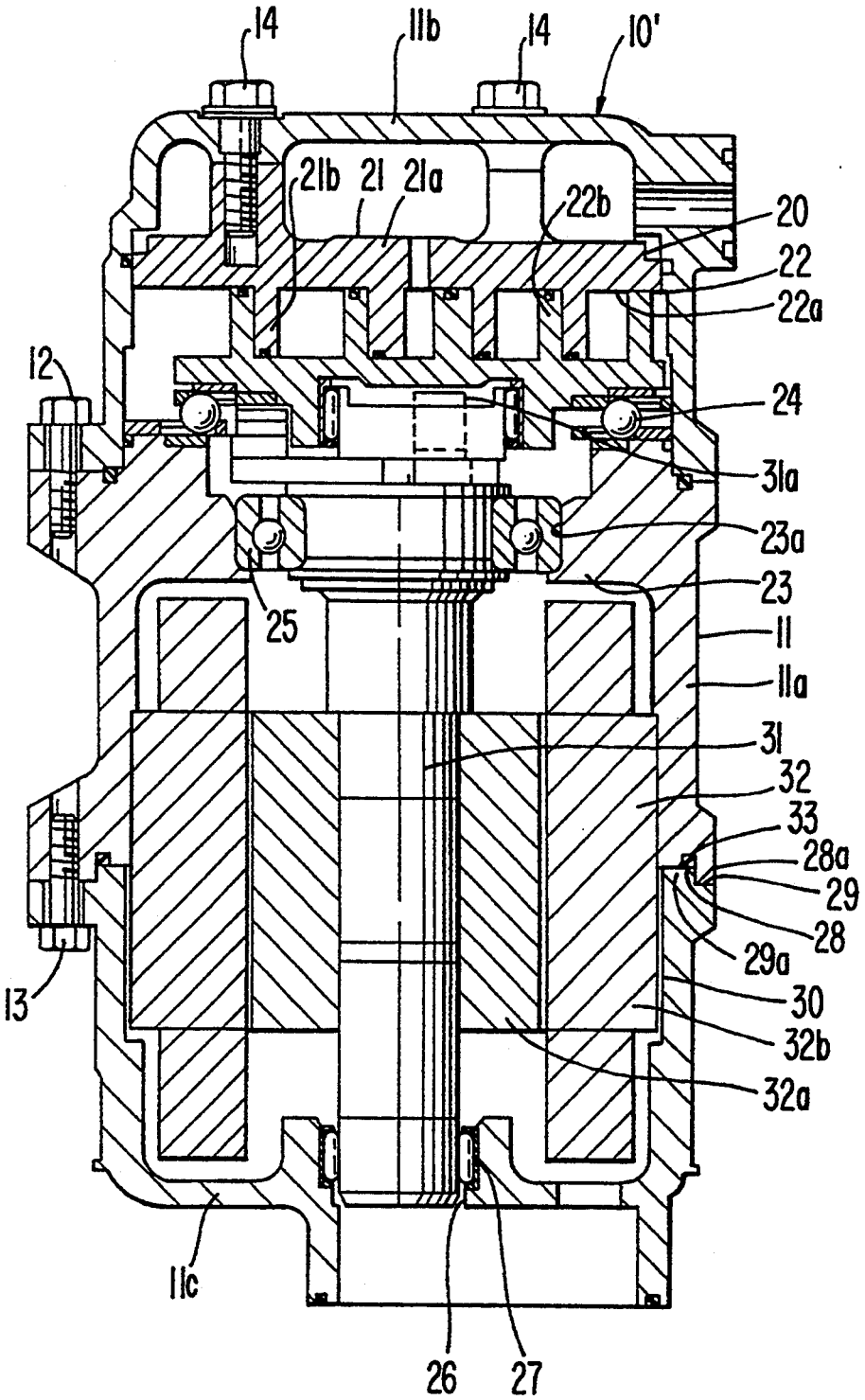
FIG. 2 is a vertical longitudinal sectional view of a motor driven fluid compressor with a hermetic housing in according with a second embodiment of this invention.
Figure 3:
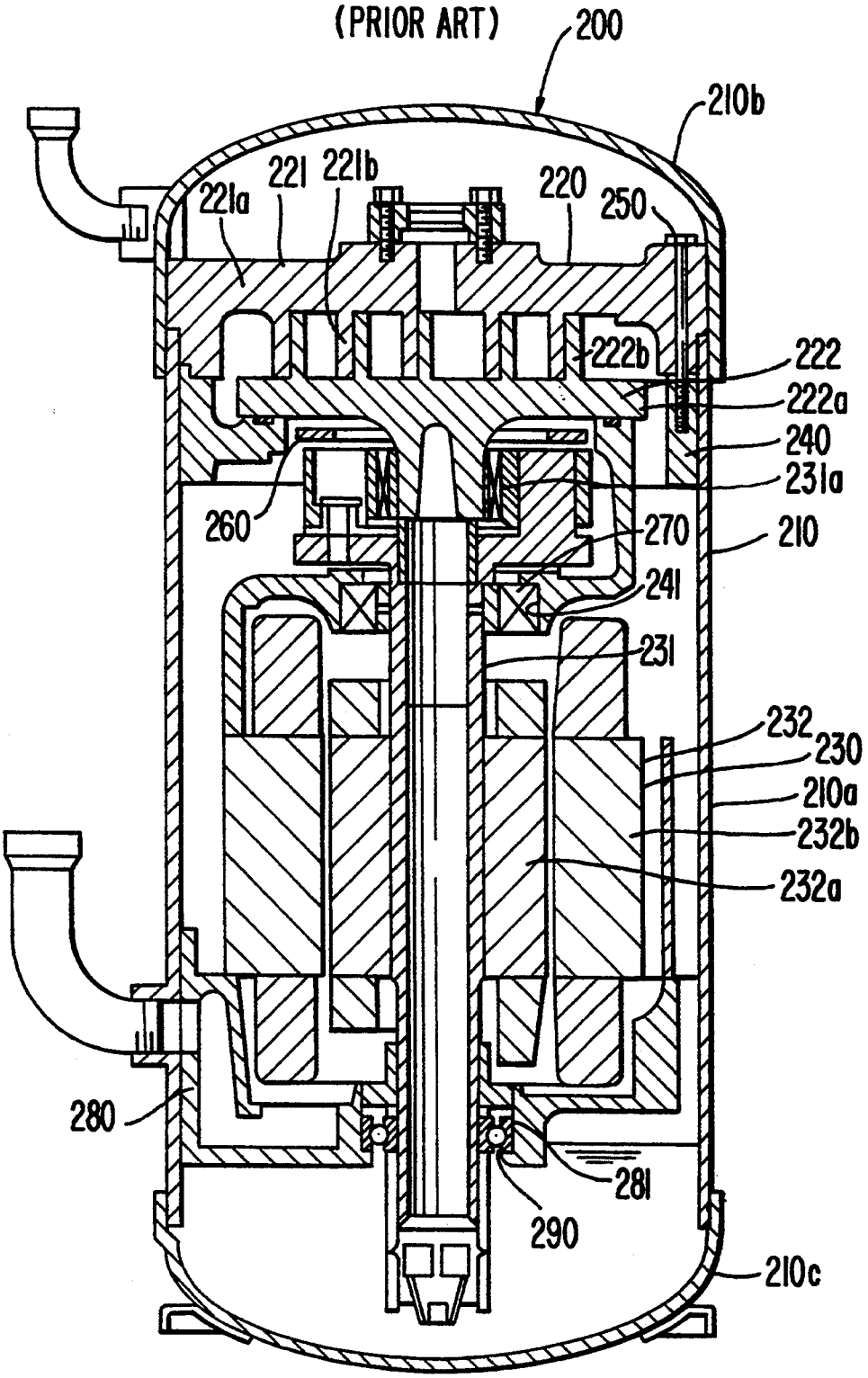
FIG. 3 (PRIOR ART)
FIG. 3 is a vertical longitudinal sectional view of a motor driven fluid compressor with a hermetic housing in accordance with one prior art embodiment.
Figure 4:
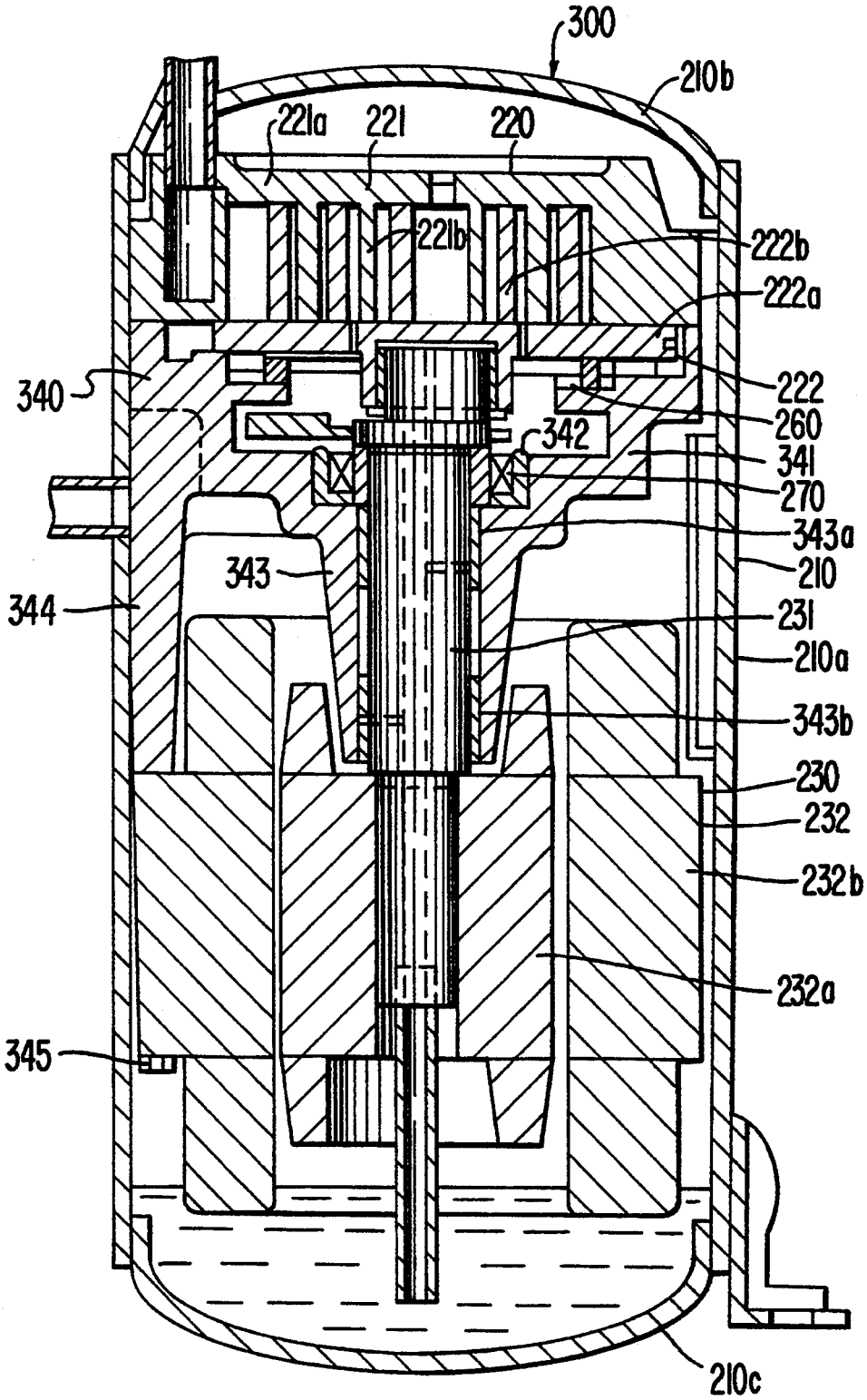
FIG. 4 (PRIOR ART)
FIG. 4 is a vertical longitudinal sectional view of a motor driven fluid compressor with a hermetic housing in accordance with another prior art embodiment.

FIG. 2 illustrates a motor driven fluid compressor in accordance with a second embodiment of the present invention. In this embodiment, an upper half portion of stator 32*b* is fixedly disposed within the lower opening end region of cylindrical portion 11*a* by, for example, forcible insertion. Other features and aspects of this embodiment have been described in the first embodiment so that an explanation thereof is omitted. Furthermore, an effect of this embodiment is similar to the effect of the first embodiment so that an explanation thereof is also omitted.

The operation of the compressors in accordance with the respective first and second embodiments of the present invention will be understood in the art so that an explanation thereof is omitted.

The present invention has been described in connection with the preferred embodiments. These embodiments, however, are merely for example only and the present invention is not restricted thereto. It will be understood by those skilled in the art that variations and modifications can be easily made within the scope of the present invention as defined by the claims.

What is claimed is:

1. A compressor comprising:

a housing including at least a first separately formed portion and a second separately formed portion;

a compressing mechanism for compressing a gaseous fluid; and a driving mechanism for driving said compressing mechanism, said driving mechanism including a drive shaft operatively connected to said compressing mechanism and a motor having an annular rotor fixedly surrounding an exterior surface of said drive shaft and an annular stator surrounding said annular rotor with a radial air gap, said annular stator disposed within both said first and second separately formed portions, said housing containing said compressing mechanism and said driving mechanism, said first separately formed portion of said housing having a first hole centrally formed therein, said second separately formed portion of said housing having first and second open ends wherein a second hole is centrally formed therein and spaced axially from said first hole, said first and second separately formed portions in abutting relationship such that said drive shaft is rotatably supported within said first and second holes.

2. The compressor of claim 1, and further comprising:

a first bearing disposed within said first hole; and a second bearing disposed within said second hole, such that said drive shaft is rotatably supported by said first and second bearings.

3. The compressor of claim 1, wherein:

said first portion of said housing includes a first opening end;

said second portion of said housing includes a second opening end facing said first opening end, said first and second opening ends joined by a faucet joint.

4. The compressor of claim 1, wherein said compressing mechanism comprises a scroll type compression mechanism.

5. The compressor of claim 1, wherein said housing is hermetically sealed.

6. The compressor of claim 3, wherein said compressing mechanism comprises a scroll type compression mechanism.

7. The compressor of claim 3, wherein said housing is hermetically sealed.

8. The compressor of claim 1, wherein an outer surface of said annular stator is in contact solely with said first separately formed portion.

9. The compressor of claim 1, wherein an outer surface of said annular stator is in contact solely with said second separately formed portion.

10. A compressor comprising:

a housing including at least a first separately formed portion and a second separately formed portion;

a compressing mechanism for compressing a gaseous fluid;

a driving mechanism for driving said compressing mechanism, said driving mechanism including a drive shaft operatively connected to said compressing mechanism and a motor having an annular rotor fixedly surrounding an exterior surface of said drive shaft and an annular stator surrounding said annular rotor with a radial air gap, said annular stator disposed within both said first and second separately formed portions, said housing containing said compressing mechanism and said driving mechanism;

a first supporting member being integral with said first separately formed portion of said housing, said first supporting member having a first hole centrally formed therein;

a second supporting member axially spaced from said first supporting member, said second supporting member being integral with said second separately formed portion of said housing, said second separately formed portion of said housing having first and second open ends and said second supporting member having a second hole centrally formed between said open ends, said first separately formed portion fixedly secured to said second separately formed portion in abutting relationship;

a first bearing disposed within said first hole; and a second bearing disposed within said second hole, such that said drive shaft is rotatably supported by said first and second bearings.

11. The compressor of claim 10, wherein said annular stator is fixedly disposed within at least one of said first and second portions of said housing.

12. The compressor of claim 10, wherein said compressing mechanism comprises a scroll type compression mechanism.

13. The compressor of claim 10, wherein said housing is hermetically sealed.

14. The compressor of claim 8 wherein an outer surface of said annular stator is in contact solely with said first separately formed portion.

15. The compressor of claim 8, wherein an outer surface of said annular stator is in contact solely with said second separately formed portion.

* * * * *